310-13 SR
FIP8502 XR 4,279,520

United States Patent [19]
Heath

[11] 4,279,520
[45] Jul. 21, 1981

[54] PRINT MECHANISM FOR WIRE PRINTER

[75] Inventor: John S. Heath, Winchester, England

[73] Assignee: International Business Machines Corporation, Armonk, N.Y.

[21] Appl. No.: 47,852

[22] Filed: Jun. 12, 1979

[30] Foreign Application Priority Data

Jun. 19, 1978 [GB] United Kingdom ..... 27243/78

[51] Int. Cl.[3] ..... B41J 3/12
[52] U.S. Cl. ..... 400/124; 400/121; 101/93.02; 310/13; 310/27; 335/223; 346/139 R
[58] Field of Search ..... 400/124, 121, 144.2; 101/93.48, 93.02, 93.33, 93.34; 310/27, 13; 335/223; 346/139 R

[56] References Cited

U.S. PATENT DOCUMENTS

| | | | |
|---|---|---|---|
| 2,931,963 | 4/1960 | Wilson | 310/13 |
| 2,942,163 | 6/1960 | Morrison | 335/223 |
| 3,117,256 | 1/1964 | Gamblin | 335/223 |
| 3,351,006 | 11/1967 | Belson | 101/93.02 |
| 3,453,463 | 7/1969 | Wildi | 310/27 |
| 3,507,213 | 4/1970 | Derc | 101/93.02 |
| 3,641,583 | 2/1972 | Cless et al. | 310/27 |
| 3,741,113 | 6/1973 | Mako et al. | 101/93.02 |
| 3,754,199 | 8/1973 | Lisinski | 101/93.04 |
| 3,830,976 | 8/1974 | Taylor | 400/124 |
| 3,842,737 | 10/1974 | Gomi | 101/93.34 |
| 3,971,311 | 7/1976 | Deproux | 101/93.04 |
| 4,005,770 | 2/1977 | Hirose et al. | 400/124 |
| 4,014,258 | 3/1977 | Wasserman | 101/93.48 |
| 4,019,235 | 5/1977 | Nijenhuis | 101/93.02 |
| 4,022,311 | 5/1977 | Krull | 400/124 |
| 4,101,017 | 7/1978 | Englund et al. | 400/124 |
| 4,129,390 | 12/1978 | Bigelow et al. | 400/121 |

FOREIGN PATENT DOCUMENTS

| | | | |
|---|---|---|---|
| 1271440 | 7/1968 | Fed. Rep. of Germany | 400/124 |
| 52-40027 | 3/1977 | Japan | 101/93.48 |

OTHER PUBLICATIONS

Rutter, Sr., "Single Turn Moving Coil Print Magnet", IBM Tech. Discl. Bulletin, vol. 13, No. 12, p. 3767, 5/71.
Eller et al., "Electromechanical Transducer", IBM Tech. Discl. Bulletin, vol. 12, No. 12, pp. 2207–2208, 5/70.
Bateson et al., "Linear . . . Hammer", IBM Tech. Discl. Bulletin, vol. 20, No. 11B, pp. 4686–4687, 4/78.
Arnold et al., "Control of—Hammer", IBM Tech. Discl. Bulletin, vol. 21, No. 11, pp. 4454–4456, 4/79.
Seifert, "Voice Coil Actuator Latch", IBM Technical Discl. Bulletin, vol. 21, No. 4, pp. 1508–1509, 9/78.

*Primary Examiner*—William Pieprz
*Attorney, Agent, or Firm*—Mitchell S. Bigel; D. Kendall Cooper; J. Jancin, Jr.

[57] ABSTRACT

A print mechanism for a wire printer has a robust single-turn closed-loop transformer secondary winding as the moving part for driving a print wire into and out of a print position. Each secondary winding threads a transformer core on which is wound a multi-turn primary winding. A stack of such secondary windings, arranged with print wires in a closely spaced print row across the stack is supported in a static magnetic field produced by a magnetic assembly. Energization of a selected primary winding induces a large current flow in its associated secondary winding which reacts with the static magnetic field to drive the associated print wire into the print position. In one embodiment, the stack of secondary windings are all mounted on a single pivot and each secondary winding swings about the pivot as a whole upon energization of its associated primary winding. In another embodiment each secondary winding of the stack is formed so as to be elastically deformable whereby the portion of the secondary winding carrying the print wire is deflected into the print position under energization of its associated primary winding.

17 Claims, 9 Drawing Figures

PRINT MECHANISM FOR WIRE PRINTER

DESCRIPTION

Technical Field

My invention relates to wire printers and in particular to a print mechanism therefor. Wire printers are well known and comprise, for example, a plurality of print wires each movable longitudinally in a respective guide tube in the print head. The guide tubes are grouped together at one end, to form a print matrix or print line, and located at a print position so that selective movements of the wires can be used to effect printing of selected characters, or parts of characters.

In one form of wire printer, print wires are arranged in a row in a print head and the paper is moved in a direction perpendicular to the direction of the row of print wires. A character is printed by the correct selection and the timed actuation of the print wires synchronized with the movement of the paper. In a matrix type of wire printer, all of the print wires required for a given character are selected simultaneously from a matrix, and all portions of a character are printed at once. In another form of wire printer, the paper is moved intermittently in a vertical direction with the print wires incrementally or continuously moved horizontally across the paper. The print head is selectively controlled to print one line at a time while the paper is stationary.

BACKGROUND ART

Electromagnetic drivers or actuators forming a part of a wire print mechanism are energized to actuate each wire as needed to form the desired character. The actuators generally comprise an electromagnet solenoid, for example, having its armature fastened to an associated wire, the energization of which produces longitudinal movement of the wire in its guide. Such a wire print mechanism is disclosed in U.S. Pat. No. 3,627,096, which is assigned to the same assignee as the present invention.

The principle limitation of this type of wire print mechanism is the maximum repetition rate at which the print wire can be fired at the paper in a controlled way. The maximum acceleration of the wire is limited by the ratio of the applied force to the mass of the moving parts. This ratio is bounded in that there is a limit to the energy that can be imparted to such an assembly by the magnetic circuit without generating an unacceptable increase in heat or causing the occurrence of physical distortion. In addition, the wire, after having been fired, bounces off the platen and returns to its original location retaining a significant proportion of the energy imparted to it. This energy must be dissipated and the wire brought to rest before it can be fired again, or resonant conditions may be set up. The problem is alleviated to some extent by the use of return springs and mechanical dampers. Finally, the build-up of current in the energizing winding is delayed by the inductance of the winding and a further limitation on speed is imposed.

DISCLOSURE OF INVENTION

According to the invention, a wire print mechanism comprises a plurality of print wires each of which is selectively movable between a retracted non-print position and an extended print position by means of individually energizable actuators. Each actuator comprises a transformer core having a primary winding, a closed-loop secondary winding, and a means for generating a static magnetic field across at least a portion of the secondary winding. The direction of the field with respect to the secondary winding is such that, it reacts with secondary current induced in the secondary winding as a result of energization of the associated primary winding, to apply a force on the portion of the secondary winding in a predetermined direction. The secondary winding is constructed and arranged so that at least said portions are free to move under the influence of the applied forces. Each wire print element is individually connected one to each of said portions of said secondary windings whereby movement of said portions causes corresponding movement of the associated print elements between retracted and extended positions.

According to one embodiment of the invention, the secondary winding is in the form of a single-turn closed-loop mounted for limited angular movement about a pivot. The direction of the applied magnetic field across a portion of the winding is such that, in the presence of induced secondary current, movement of the winding as a whole is produced about the pivot. In order to form a wire print row, a number of secondaries are stacked on a common pivot, the secondaries being stacked in parallel on the side of the pivot containing that part of the secondary winding on which the print wire is mounted. On the side of the pivot where the transformer cores are mounted, the secondary windings are fanned out, to accommodate the individual transformer cores.

According to another embodiment of the invention, the secondary winding is in the form of a self-supporting single-turn closed-loop. The construction of the secondary winding is such that a portion of the winding is elastically deformable in the plane of the winding. The magnetic field is applied across said portion in a direction such that in the presence of induced secondary current of a predetermined direction in said secondary winding, said portion is deflected from a stable rest position to an unstable deflected position. In order to form a wire print row, a number of single-turn closed-loop secondary windings are closely stacked within one another. A projecting member hereinafter termed a crank, is provided on each secondary winding to accommodate the individual transformer cores.

BRIEF DESCRIPTION OF THE DRAWINGS

In order that the invention may be fully understood, the preferred embodiments thereof will now be described by way of example, with reference to the accompanying drawings, in which.

BEST MODE FOR CARRYING OUT THE INVENTION

Figure 1:
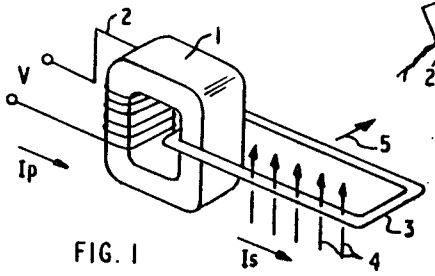
FIG. 1 shows a schematic representation of the electromagnetic actuator incorporated in the present invention.

The principle of operation of the actuator incorporated in the wire print mechanism according to the present invention, is shown in the schematic diagram of FIG. 1. Here a transformer core 1 of soft magnetic material carries a multi-turn primary winding 2 and a single-turn closed-loop secondary winding 3. Although the closed-loop secondary winding may have more than one turn, the embodiments to be described utilize single-turn closed-loop secondary windings of fairly robust formerless construction. The assembly of magnetic core 1 and windings 2 and 3 behave as a conventional transformer and may be analyzed and designed as is well known in the transformer art. Thus, application of current Ip to primary winding 2 generates a changing magnetic field in the core 1 which in turn induces current Is in secondary winding 3 by transformer action. If now, a magnetic field, represented by arrows 4, is applied across one limb of the secondary winding 3, then, with secondary current Is flowing in the direction shown, that limb of the winding 3 experiences a force tending to move it in the direction of arrow 5. Reversal of direction of primary current Ip results in reversal of the applied force thereby tending to move the limb in the opposite direction.

By mounting secondary winding 3 for rotation about a pivotal axis disposed at right angles to the plane of the winding, and situated at one end of the aforesaid limb (for example, in the vicinity of the transformer core 1), movement of the secondary winding about this axis can be controlled by application of primary current Ip to the primary winding 2. A hard print wire attached to the moving part of the secondary winding can thus be controlled for striking a ribbon/paper/platen combination to produce a print mark on the paper in the usual way. Alternatively, if the secondary winding 3 is fixed, but elastically deformable so that the limb across which the magnetic field is applied is flexible or deflectable, then application of primary current Ip to the primary winding produces movement of the limb in a direction determined by the direction of applied primary current. In this case, printing can be achieved by means of a print wire attached to the flexible or deflectable limb of the secondary winding.

Each of these embodiments for carrying out the invention are further described below. Clearly, however, the secondary winding may be a single turn or multi-turn closed-loop winding. Any movement of the secondary winding whether by rotation about one axis or another, deformation of the winding itself or linear motion of the winding can be used to move a print wire into and out of a print position. The print wires also may take any of several forms. For example, as in the embodiments to be described, print wires are in the form of short wires carried by the secondary windings themselves. Alternatively, they may be in the form of extended print wires which are connected for driving purposes to the secondary windings but separately supported at the other end in a print head.

Figure 2:
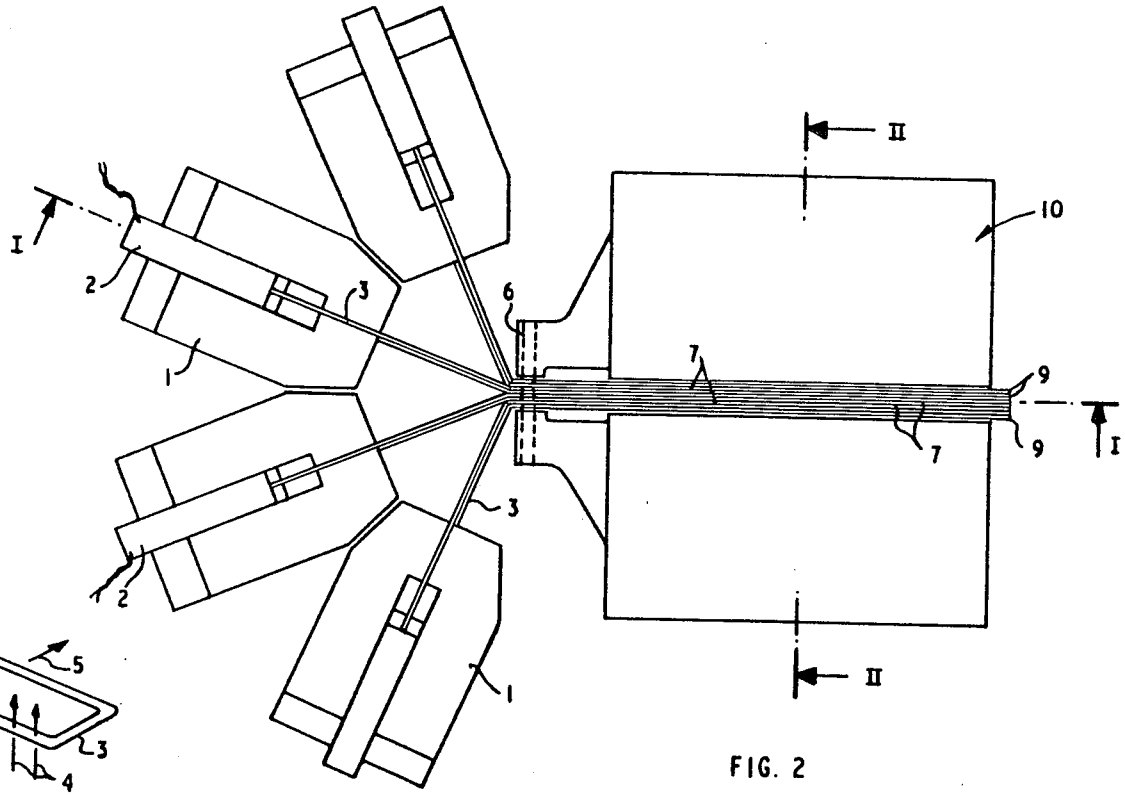
FIG. 2 shows a plan view of one embodiment of a wire print mechanism according to the invention.
Figure 3:
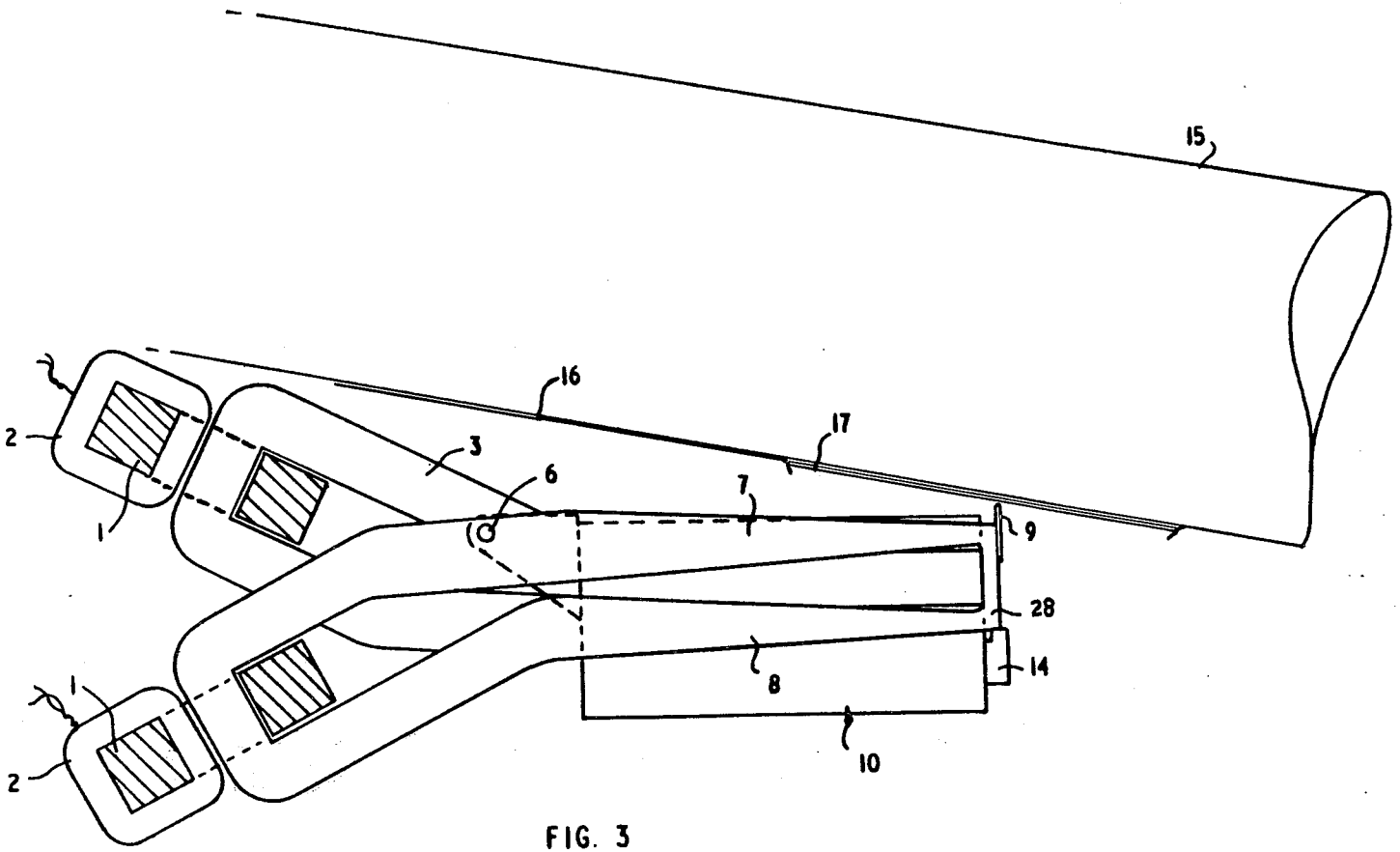
FIG. 3 shows a sectional view along line I—I in FIG. 2.
Figure 4:
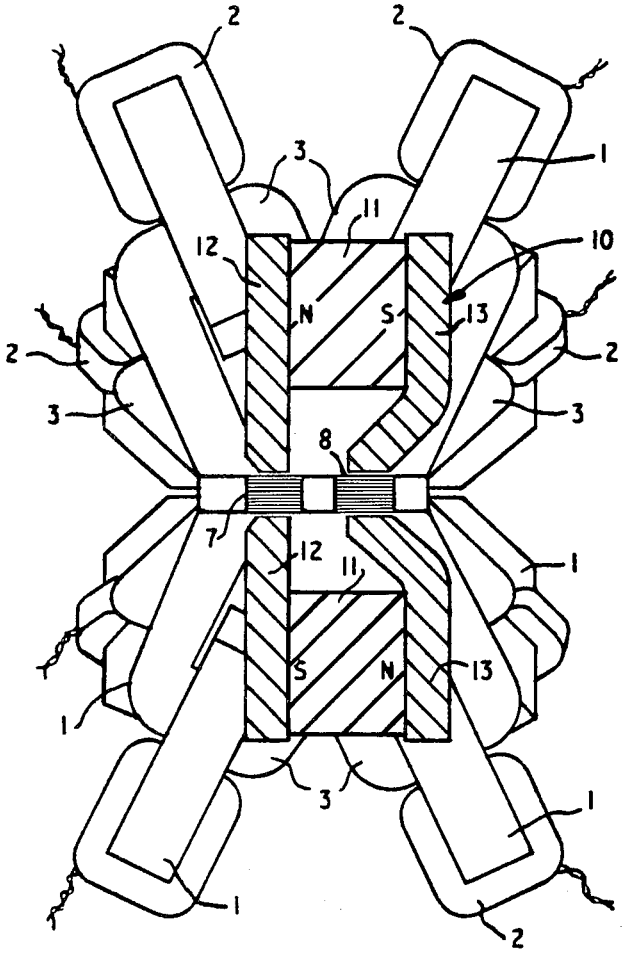
FIG. 4 shows a sectional view along line II—II in FIG. 2.
Figure 5:
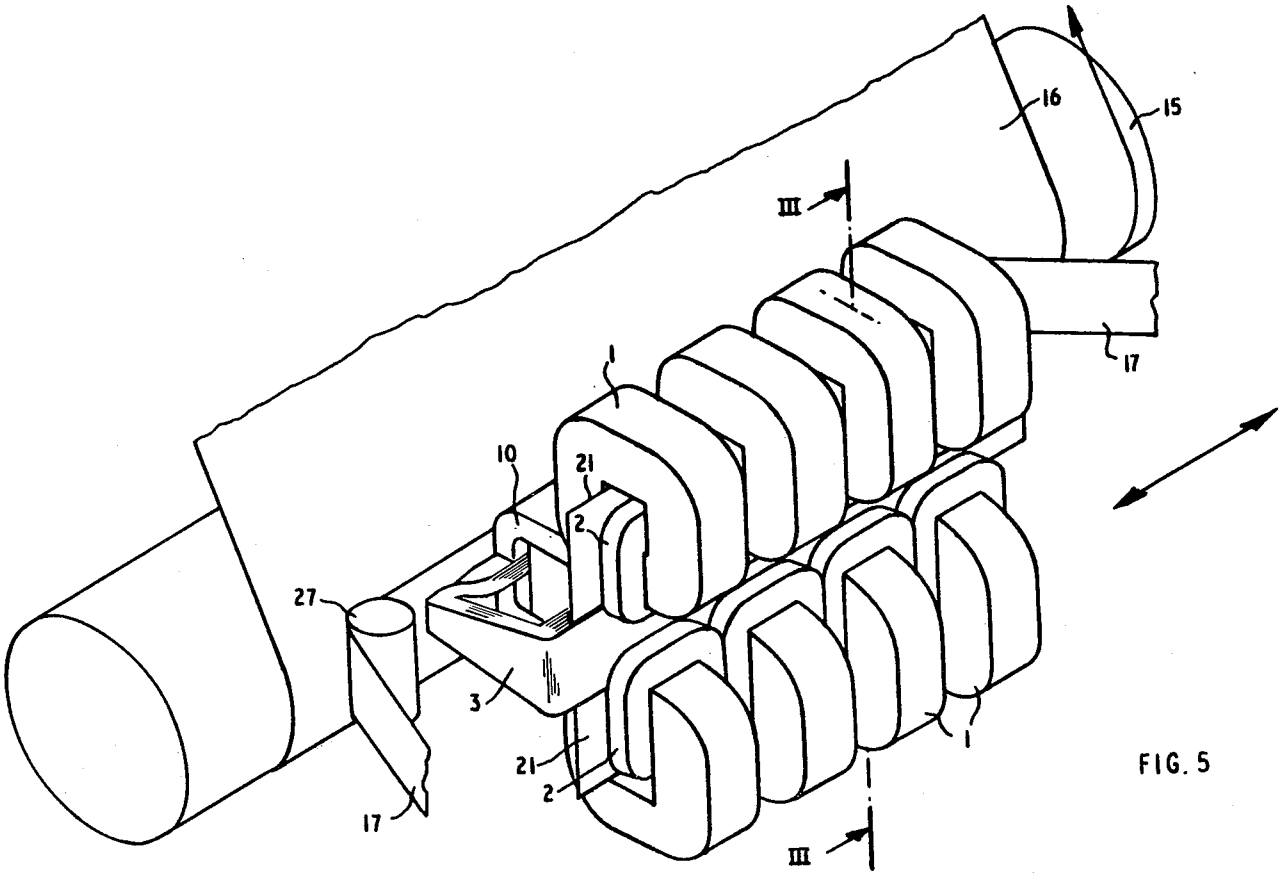
FIG. 5 shows an isometric view of a second embodiment of a wire print mechanism according to the invention.
Figure 6:
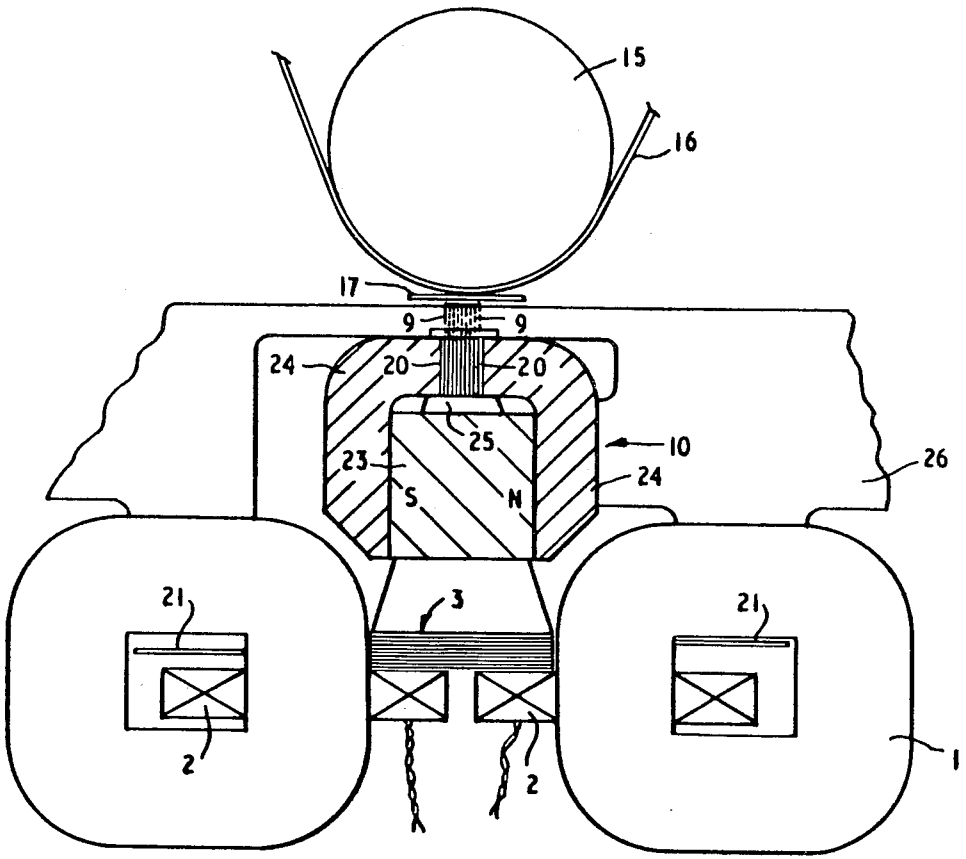
FIG. 6 shows a sectional view along line III—III in FIG. 5.
Figure 8:
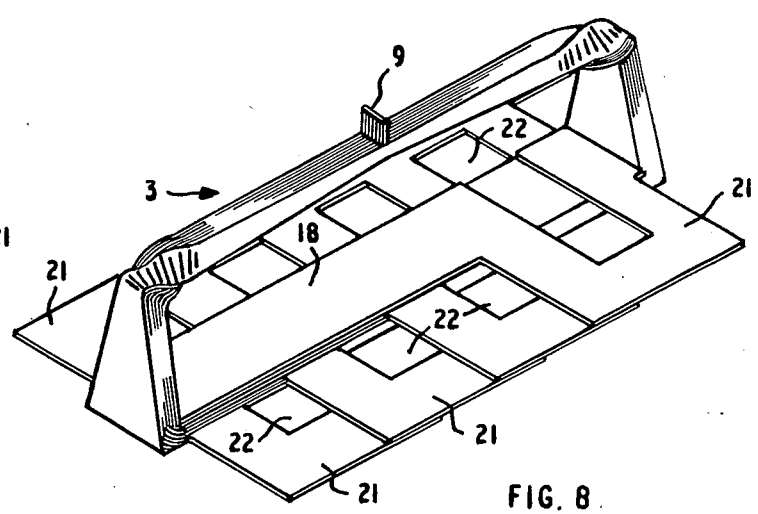
FIG. 8 shows a stack of secondary windings forming part of the wire print mechanism shown in FIG. 5.
Figure 7:
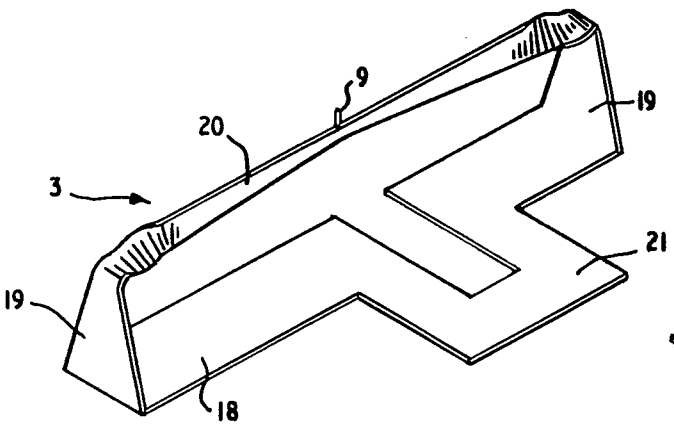
FIG. 7 shows a single secondary winding forming part of the wire print mechanism shown in FIG. 5.

FIGS. 2, 3 and 4 show various views of a wire print mechanism in which each of a row of closely spaced print wires is controlled by an individually driven pivoted secondary winding arrangement. FIGS. 5 and 6 show two views of a wire print mechanism in which each print wire is controlled by an individually driven flexible or deflectable secondary winding arrangement. FIGS. 7 and 8 show details of the print mechanism shown in FIGS. 5 and 6.

The first embodiment of the wire print mechanism is shown in plan view in FIG. 2; as a section along line I—I in FIG. 3, and a section along line II—II in FIG. 4. From these figures, the wire print mechanism is seen to comprise, in part, a number (in this case eight) of single-turn closed-loop secondary windings 3, each formed from a thin aluminum sheet, or other suitable material, stacked together and mounted on a common pivot 6. On one side of the pivot 6, each secondary winding consists of two elongated limbs 7 and 8 and short connecting limb 28, and are closely stacked parallel to each other. Each limb 27 carries a wire 10 of hard material suitable for performing print operations on a ribbon/paper combination. The wires on the secondary windings together form a closely spaced print row as required in the wire printer art for performing printing operations. The secondary windings are free to rotate independently of each other through a small angle about pivot 6. Thin layers of wear-resistant material such as polyimide (not shown in the figures) insulate the secondaries from each other and provide lubrication. Alternatively, insulation may be provided by an anodized layer on the aluminum secondaries.

In order to provide sufficient space for individual transformer cores 1 to thread each secondary winding, the secondary windings are fanned out in two planes at angles to each other on the side of the pivot remote from the print wires 9. Thus, as shown in the sectional view of FIG. 3, pairs of secondaries are fanned out, in alternate directions, with respect to the longitudinal axis of pivot 6. These pairs of secondary windings are additionally fanned out in a plane at right angles to the plane of the bends as shown in the plan view of the wire print mechanism shown in FIG. 2. The relative disposition of the individual secondary windings 3 and associated transformer cores 1 is further illustrated in the sectional view of FIG. 4.

Each transformer core 1 carries a multi-turn primary winding 2, which when energized induces a large current flow in its associated single-turn closed-loop secondary winding 3. A permanent magnet structure 10 (shown generally in FIGS. 2 and 3 and in more detail in FIG. 4) mounted on the side of the pivot 6 opposite from the transformer cores 1 provides a large magnetic field across the closely spaced parallel limbs 7 and 8 of all the secondary windings 3. More specifically, as shown in FIG. 4, the magnet structure consists of two bar magnets 11 having pole-pieces 12 and 13 arranged to define two magnetic flux gaps in which the two closely stacked groups of elongated limbs 7 and 8 of the secondary windings are respectively located. The magnetic fields across the gap defined by pole-pieces 12, containing secondary limbs 7, and the gap defined by pole-pieces 13, containing secondary limbs 8, co-act additively with the currents Is in the secondary windings to cause a torque to be exerted on those windings in which secondary current Is is flowing. Consequent rotation of these secondary windings about pivot 6 moves the associated print wires 9 towards and away from a print position. Sufficient clearance between transformer cores 1 and secondary windings 3 permit movement of the wires for printing to occur. In addition, a rest position for the secondary windings is provided by a stop 14 (shown only in FIG. 3) of resilient material. A return spring (not shown) may be fitted to each secondary winding to hold it against the stop 14 when not being energized. However, as will be described later with reference to FIG. 9, this particular invention enables the entire movement of print elements into and out of the print position, and the restoration of elements to the rest position to be entirely controlled electrically by appropriate energization of the primary windings.

In use, the print mechanism is mounted, as shown in FIG. 3, with the row of print wires 9 adjacent and aligned at right angles to the longitudinal axis of a print platen 15 over which paper 16 to receive print is fed. A ribbon feed mechanism (not shown) increments an inked ribbon 17 interposed between the print wires 9 and paper 16 in the usual manner.

The operation of this print mechanism is as described in general previously. By selective energization of primary windings 2, any print wire or combination of print wires 9, can be caused to impact the interposed ribbon 17 and produce corresponding printed marks on paper 16 carried by platen 15. Relative movement between paper and print mechanism necessary to print in rows may be achieved by any of a number of well known means. For example, the print mechanism may be held stationary and the platen carrying the paper moved in the direction of its longitudinal axis with incremental line shifts between rows as required. Alternatively, the platen may be fixed and the print mechanism itself moved in a print carriage along the length of the platen. The print carriage may support the ribbon feed mechanism, or this may be provided as an independent mechanism. These various arrangements are all well known in the printer art and since they form no part of the present invention, except as a vehicle in which it is used, they are not described in this specification.

The second embodiment of the invention is shown in isometric view in FIG. 5 and in section along line III—III in FIG. 6. From these figures, the wire print mechanism is seen to comprise, as in the previous embodiment, a number (in this case eight) of single-turn closed-loop secondary windings 3 each formed from a thin aluminum sheet or other suitable material, and having an associated transformer core 1 carrying a multi-turn primary winding 2. In this embodiment, the print action relies on elastic deformation of the secondary windings 3 rather than their rotation about a pivot. The secondary windings 3 are closely stacked together and each carries a print wire 9 positioned midway along a specially formed flexible or deflectable limb of the secondary winding. FIG. 7 shows a single secondary winding 3 having a flat main structural limb 18, two flat side limbs 19, and a flexible or deflectable limb 20 carrying a print 9 at its midpoint. The limb 20 is provided with two 90° twists, one at each end of the limb, between it and the two side limbs 19 so that the width of the limb lies in the plane of the print wire 9. The width of the secondary winding is also reduced along the limb 20 to make it more flexible, but maintained relatively large elsewhere in order to reduce electrical resistance. Rotation of the plane of limb 20 through 90° in this manner provides increased flexibility of the limb 20 and enables a number of secondary windings 3 (in this case eight) to be closely stacked together as shown in FIG. 8. Clearly, in order for this to be possible, the secondaries must become progressively larger by small amounts from inside to outside the stack. A crank 21 is provided in the main limb 18 of each secondary for accommodating a transformer core 1. Each crank 21 is progressively offset from its neighbor to provide sufficient space for all the transformer cores 1. In this embodiment, the cranks 21 provided equally spaced transformer apertures 22 along each side of the stack of secondaries. The secondaries are electrically insulated from each other either by an anodized coating or by an insulating layer of wear-resistant material such as polyimide which also acts as a lubricant between the secondaries in the stack.

The transformer cores 1 are shown in FIG. 5 threaded through transformer apertures 22, each uniquely associated with a secondary winding 3 in the stack. Each transformer core 1 carries a multi-turn primary winding 2 which when energized induces a large current flow in its associated secondary winding 3. A permanent magnet structure 10 (shown generally in FIG. 5 and in more detail in FIG. 6) provides a large magnetic field across the closely spaced limbs 20 of the secondary windings. More specifically (as shown in FIG. 6), the magnet structure consists of a single bar magnet 23 having pole-pieces 24 arranged to define a magnetic flux gap in which the closely stacked group of limbs 20 of the secondary windings are located. The direction of flux across the gap is such that it coacts with secondary current Is to generate a force in the winding which causes deflection of the limb 20 and movement of the print wire 9 towards and away from a print position. A resilient stop 25 provides a rest position for the secondary windings. In this embodiment, the elasticity of the windings is sufficient to hold them against the stop 25 when they are not being energized.

In use, the print mechanism is mounted on a stationary or movable carriage 26 (part shown in FIG. 6) as in the previous embodiment, the row of print wires 9 being adjacent and aligned at right angles to the longitudinal axis of a print platen 15 over which paper 16 is fed. A ribbon feed mechanism (not shown) increments an inked ribbon 17 interposed between print wires 9 and paper 16. One ink ribbon roller 27 is visible in FIG. 5. By selective energization of primary windings 2 any print wire or combination of print wires 9 can be caused to impact the interposed ribbon 17 and produce corresponding printed marks on the paper 16.

Figure 9:
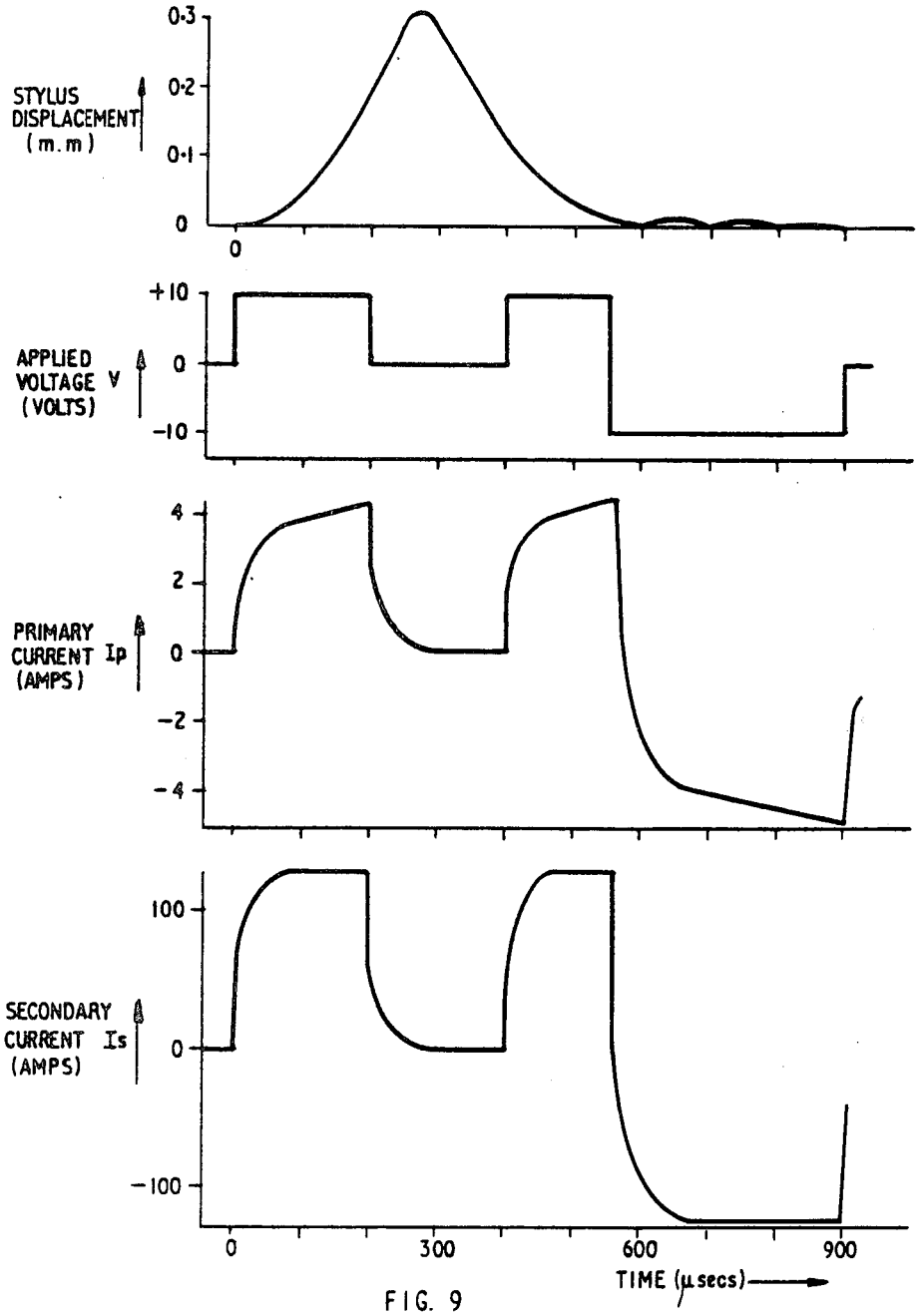
FIG. 9 shows various graphs to illustrate the operation of the various mechanisms according to the invention.

Operation of the wire print mechanism is generally illustrated by reference to FIG. 9 which shows a graph of print wire movement and the values of applied voltage V, primary current Ip, and secondary current Is throughout one cycle of motion of a wire print mechanism having pivoted secondary windings. For the first 200 microseconds, 10 volts is applied to the primary winding of a selected print wire. The primary current Ip builds up to a maximum of 4 amperes and a secondary current Is of about 130 amperes is induced in the associated secondary winding. This large current coacts with the applied magnetic field to move the print wire towards the print position. The voltage is removed after being applied for 200 microseconds and the secondary winding continues its movement until the print wire strikes the platen and rebounds therefrom. The print wire typically moves 0.3 mm from its rest position to the platen. At 400 microseconds from the start of the cycle, the voltage is re-applied to arrest the motion of the secondary winding until at around 550 microseconds the winding is approaching its rest position once again with a small residual velocity. At this point, the applied voltage is reversed thereby holding the winding against its stop. Small rebounds of the winding occur. At 900 microseconds from the start of the cycle, the flux in the transformer core has decayed to zero and the reverse applied voltage can be removed or alternatively another cycle commenced.

Operation of wire print mechanisms of other construction according to the invention such as those having deformable secondary windings or other arrangements in which secondary winding movement is used to effect printing, generate waveforms of a similar nature. It should be noted however that the actual shape and values of the waveforms will change from mechanism to mechanism depending on the various parameters of the structures used. The described example referenced to FIG. 9 has been included to show typically how the present mechanism is driven in a controlled manner during printing to improve the efficiency of the print operation.

As has already been mentioned, present wire print mechanisms have performance limitations governed by the maximum repetition rate at which the print wires can be fired in a controlled manner. The present invention shows an improvement in three fundamental limitations of present wire print mechanisms.

The transformer construction provides physical separation between primary winding and the moving secondary winding enabling the secondary winding to be physically larger than the equivalent solenoid operated print wire. Further, primary winding heat is isolated from the more sensitive moving secondary windings permitted more power to be applied to the mechanism.

The rate at which current is built up in the secondary winding is very much higher than possible in a directly energized device due to the single-turn closed-loop nature of the secondary winding (inductance is proportional to the square of the number of turns of a winding). From FIG. 9, it is seen that secondary current is fully established in 100 microseconds whereas with solenoid operated print wires current is still increasing even at the end of the energized period (typically 400 microseconds).

The bi-directional nature of the driving forces in the mechanism of the present invention, and the ability to change secondary current rapidly, enables the motion of the print wires to be controlled during both forward movement to the print position and return movement to the rest position without large rebounds from the stop. This is a significant improvement over state-of-the art solenoid operated wire printers in which the driving force is always unidirectional and the time require to change solenoid current is relatively long.

Having thus described my invention, what I claim as new, and desire to secure by Letters Patent is:

1. A print mechanism for a wire printer comprising:

a plurality of print elements;

a plurality of individually energizable actuator assemblies each of which includes a primary winding, an associated closed-loop secondary winding having at least a portion thereof movable between a first and a second position, and a transformer core for magnetically coupling the primary winding to its associated secondary winding;

means for generating a static magnetic field across each of the aforesaid movable portions of the secondary windings;

means for fixedly connecting each of said plurality of print elements to a respective one movable portion of each secondary winding; and means for energizing a primary winding to induce a current in an associated secondary winding so that such induced current reacts with said static magnetic field to produce a force on the movable portion thereof in a predetermined direction from the first to the second aforesaid position, and thereby effect a corresponding movement of the print element from a retracted non-print position to an extended print position;

said secondary winding being of the form of a self-supporting single-turn closed loop of an elongated substantially rectangular shape of thin sheet material, the sheet material forming two long limbs and two short side limbs of the rectangle lying in planes at right angles to the plane of the loop, the first one of said long limbs being twisted at its ends with respect to the short limbs so that the first long limb is flexible and may be deflected in the plane of the loop, the static magnetic field being applied across the portion in a direction such that induced secondary winding current creates a force to deflect the portion from a stable rest position to an unstable deflected position;

a plurality of said loops, each of the same general shape but of slightly differing dimensions, being stacked together, electrically insulated from each other, with the deflectable limbs of each of said loops closely parallel to each other, so that the print elements mounted on said deflectable limbs are aligned in a print row across the width of the stack, said other long limb of each loop being supported one upon the other and having a crank portion defining an aperture between the crank and the remainder of the stack of loops for receiving a transformer core, the cranks being disposed between adjacent loops so as to provide sufficient space to accommodate the associated transformer cores.

2. A print mechanism as claimed in claim 1 wherein the material from which each loop is formed is aluminum, and wherein the surface of each loop is anodized to provide electrical insulation between adjacent loops in the stack.

3. A print mechanism as claimed in claim 1 in which each loop is provided with a wear-resistant coating of polymide.

4. A print mechanism for a wire printer comprising:

a plurality of print elements;

a plurality of individually energizable actuator assemblies each of which includes a primary winding, an associated closed-loop secondary winding having at least a portion thereof movable between a first and a second position, and a transformer core for magnetically coupling the primary winding to its associated secondary winding;

said secondary winding being in the form of a self-supporting single-turn closed-loop having an elastically deformable portion in the plane of said winding, said self-supporting single-turn closed-loop being of an elongated substantially rectangular shape of thin sheet material, the sheet material forming two long limbs and two short side limbs of the rectangle lying in planes at right angles to the plane of the loop, the first one of said long limbs being twisted at its ends with respect to the short limbs so that the first long limb is flexible and may be deflected between a stable rest position and an unstable deflected position;

means for generating a static magnetic field across each of the aforesaid movable portions of the secondary windings;

means for fixedly connecting each of said plurality of print elements to a respective one movable portion of each secondary winding; and means for energizing a primary winding to induce a current in an associated secondary winding so that such induced current reacts with said static magnetic field to produce a force on the movable portion thereof in a predetermined direction from the first to the second aforesaid position, and thereby effect a corresponding movement of the print element from a retracted non-print position to an extended print position.

5. A print mechanism for a wire printer comprising:

a print element;

an actuator assembly including a primary winding, a self-supporting single turn closed conductive loop secondary winding having an elastically deformable portion movable between a stable rest position and an unstable deflected position the remainder of said secondary winding being fixed relative to said primary winding, and a transformer core for magnetically coupling said primary winding to said secondary winding;

means for generating a static magnetic field across the elastically deformable portion of said secondary winding;

means for fixedly connecting said print element to the elastically deformable portion of said secondary winding; and means for energizing said primary winding to induce a current in said secondary winding to produce a deflecting force on, and a movement of, the elastically deformable portion to its unstable deflected position, and to thereby effect a corresponding movement of the print element from a retracted non-print position to an extended print position.

6. A print mechanism according to claim 5 wherein the elasticity property of the elastically deformable portion of said secondary winding returns the elastically deformable portion to its stable rest position, whereby said print element is returned from an extended print position to a retracted non-print position.

7. A print mechanism for a wire printer comprising:

a plurality of print elements;

a plurality of individually energizable actuator assemblies each of which includes a primary winding, an associated secondary winding, and a transformer core for magnetically coupling the primary winding to its associated secondary winding;

each aforesaid secondary winding having four limbs in self-supporting single-turn substantially rectangular closed-loop form, wherein one of said limbs is elastically deformable between a stable rest position and an unstable deflected position and the other three limbs are fixed relative to their associated primary windings;

means for fixedly connecting each of said plurality of print elements to a respective one elastically deformable limb of each secondary winding; and means for energizing a primary winding to induce a current in an associated secondary winding so that such induced current reacts with said static magnetic field to produce a force on the elastically deformable limb thereof in a predetermined direction and to effect a deflection thereof from the rest position to the deflected position, and thereby effect a corresponding movement of the print element fixedly connected to the elastically deformable limb between a retracted non-print position and an extended print position.

8. A print mechanism for a wire printer comprising:

a plurality of print elements;

a plurality of individually energizable actuator assemblies each of which includes a primary winding, an associated single-turn, self-supporting closed-loop secondary winding, and a transformer core for magnetically coupling the primary winding to its associated secondary winding;

each of the aforesaid secondary windings having a portion which is elastically deformable between a stable rest position and an unstable deflected position;

each of the aforesaid secondary windings being of the same general shape but of slightly differing dimensions;

the secondary windings being disposed within one another to form a stack, with said secondary windings electrically insulated from each other, and with the elastically deformable portions of the secondary windings aligned in a print row across the width of the stack;

means for generating a static magnetic field across part of each deformable portion;

means for fixedly connecting one of said plurality of print elements to a respective one deformable portion of a secondary winding; and means for energizing a primary winding to induce a current in the associated secondary winding so that the induced current reacts with said static magnetic field to produce a force on the deformable portion of the associated secondary winding in a predetermined direction to effect a deflection thereof from the rest position to the deflected position, and to thereby effect a corresponding movement of the print element fixedly connected thereto from a retracted non-print position and an extended print position.

9. The print mechanism of claim 8 wherein each secondary winding further includes a crank defining an aperture between the crank and the stack of secondary windings for reciving a transformer core, the cranks being disposed between adjacent secondary windings so as to provide sufficient space to accommodate the associated transformer cores.

10. The print mechanism of claim 8 wherein each of the secondary windings is of planar shape.

11. The print mechanism of claim 8 wherein each of the secondary windings is a planar rectangular loop of thin conducting sheet material, having two long limbs and two short side limbs, the two short side limbs and the first long limb lying in planes at right angles to the plane of the secondary winding, and the second long limb being twisted at its ends so that it lies in the plane of the secondary winding and is flexible.

12. The print mechanism of claim 11 wherein one of said plurality of print elements is fixedly connected to a respective one deformable portion of each secondary winding at the midpoint of said second long limb to form a print row lying in a plane parallel to the planes of said two short side limbs.

13. The print mechanism of claim 11 wherein each first long limb further includes a crank, defining an aperture between the crank and the stack of secondary windings for receiving a transformer core, the cranks being disposed between adjacent secondary windings so as to provide sufficient space to accommodate the associated transformer cores.

14. A print mechanism as claimed in claim 8 wherein each secondary winding is aluminum, and wherein the surface of each secondary winding is anodized to provide electrical insulation between adjacent secondary windings in the stack.

15. A print mechanism as claimed in claim 8 in which each secondary winding is provided with a wear-resistant coating of polymide.

16. A print mechanism according to claim 8 wherein the elasticity property of the deformable portion of said secondary winding returns the deformable portion to its stable rest position, when said energizing means ceases energizing the associated primary winding whereby said print element is returned from an extended print position to a retracted non-print position.

17. A print mechanism according to claim 8 in a printer further comprising a platen for supporting paper to be printed;

means for applying current pulses of a first polarity to selected primary windings so as to effect movement of associated secondary winding print elements towards said platen, the magnitude of the pulses being sufficient to cause said elements to rebound from said platen;

means for applying additional pulses of the first polarity to the aforesaid selected primary windings after the associated print elements have rebounded from said platen so as to retard but not stop said print elements during their movement towards the retracted position; and means for applying pulses of second polarity to said selected primary windings when said print elements approach the retracted position to maintain the print elements in the retracted position.

* * * * *